United States Patent [19]

Schaefer

[11] Patent Number: 4,927,153

[45] Date of Patent: May 22, 1990

[54] GOLF PUTTING PRACTICE DEVICE

[76] Inventor: John P. Schaefer, 2533 Pepperidge Dr., Garland, Tex. 75044

[21] Appl. No.: 309,373

[22] Filed: Feb. 13, 1989

[51] Int. Cl.[5] ..... A63B 69/36

[52] U.S. Cl. ..... 273/187 R; 273/35 A; 273/183 E

[58] Field of Search ..... 273/35 A, 183 E, 192, 273/187 R, 187 A, 187 B

[56] References Cited

U.S. PATENT DOCUMENTS

| | | | |
|---|---|---|---|
| 3,934,874 | 1/1976 | Henderson | 273/192 |
| 4,563,010 | 1/1986 | McDorman et al. | 273/35 A |
| 4,736,952 | 4/1988 | Taft et al. | 273/183 E |

*Primary Examiner*—George J. Marlo

[57] ABSTRACT

A golf putting device which provides immediate feedback on eye positioning relative to the golf ball. The system is completely passive and does not interfere with the golfers putter, hand position or natural set-up. Two small plano mirror are mounted perpendicular to one another on an L-shaped base. The first mirror is mounted on a fixed inclined base, faces the golfer, and ensures forward-backward eye positioning. The second mirror is mounted on an adjustable tilt base, is to the right of the golfer, and ensures inside-outside eye positioning. The collimated reflection plane of each plano mirror intersects directly above the golf ball. A pivoting arm positions the golf ball directly below the reflection intersection plane. A guide rail is provided to ensure the stroke remains along the intended line.

14 Claims, 6 Drawing Sheets

GOLF PUTTING PRACTICE DEVICE

BACKGROUND OF THE INVENTION

This invention relates to practice putting and a device that provides the golfer with feedback on his eye position in relation to the golf ball. It also provides a mechanism for the golfer to easily detect any detrimental head movement occurring during the stroke.

One of the most important aspects of the game of golf is the ability to putt consistently well. The key to consistent putting is the ability to align ones eyes directly over the golf ball and for them to remain fixed throughout the stroke. The key to solid contact and a true roll of the ball is the ability of the golfer to never let the putter path move outside the intended line of the putt.

Several attempts have been made to create a device that will provide the fore mentioned critical information to the golfer. Henderson U.S. Pat. No. 3,934,874 and Whittaker U.S. Pat. No. 3,934,882 describe a flat member containing reflective material on which the golf ball is placed and subsequently putted from. The major flow in these two inventions is that the golf ball and stroke must be played from the top of the mirror, which is not conducive to realistic putting. O'Flanagan U.S. Pat. No. 4,601,472 describes a mirror sighting device which must be clamped to the putter. This device adds extra weight to the putter and the attached reference mirror provides false information to the golfer regarding the location of his eyes relative to the golf ball. This device, and others which provide cross hairs on the putter, depend upon the golfer to place the bottom of the putter exactly flat on the putting surface in order to provide accurate golf ball and eye positioning information.

SUMMARY OF THE INVENTION

It is therefore the object of the present invention to provide a practice putting device which greatly improves the users ability to putt consistently well.

It is a further object of the present invention to provide the golfer with an accurate mechanism for determining his eyes position in relation to the golf ball during practice putting.

It is further and object of the present invention to provide a method for the golfer to quickly and accurately determine and subsequently eliminate detrimental head movement which invariably occurs during a putting stroke.

It is likewise the object of the present invention to help the golfer develop a consistent and repeatable set-up by providing an extremely accurate non-contact mechanism for repeating the height one sets up over the golf ball during putting.

It is further the object of the present invention to help the golfer develop a repetitious, inside the line, putting stroke which will increase his ability to consistently hole putts.

Other objects and advantages of the invention will become apparent upon reading the following detailed description and upon reference to the drawings.

DETAILED DESCRIPTION OF THE INVENTION

Figure 1A:
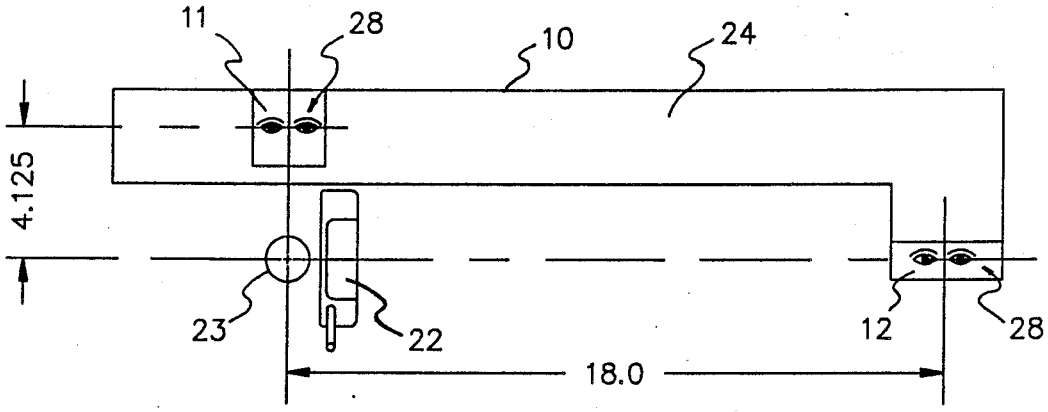
FIG. 1*a* A plan view of the simplest embodiment of the present invention showing the perpendicularity placement of the mirrors and image the golfer sees in the mirrors when his eyes are directly over the golf ball at address.

While the invention will be described in connection with the preferred embodiment, it will be understood that I do not intend to limit the invention to that embodiment. On the contrary, I intend to cover all alterations, modifications, and equivalents as may be included within the spirit and scope on the invention as defined by the appended claims.

In order to become a consistent putter, one must be able to repeatedly set up to the ball and position ones eyes directly over the golf ball and parallel to the intended line. One must be consistent in his set-up and be able to stroke the putter along the intended line and never move the putter outside the line on the take away. During the stroke, it is crucial for the golfer's head and eyes to remain fixed on the ball and remain steady during the stroke and follow through. A lifting or peeking of the eyes and head during the stroke moves the shoulders which causes the putter and ball to skew off line.

With regard to positioning ones eyes directly over the ball and parallel to the line, the present invention provides the golfer with a means of determining when his eyes are directly over the ball. When the golfer positions his head so that his eyes are visible to him in both mirrors at the same time, he then knows he is directly over the ball and can stroke putts with confidence. The first mirror best provides the feedback regarding eye parallelism or head tilt to intended line and corrections can be made before stroking the putt. The tendency of the golfer is to line the putter blade perpendicular to his eyes. By knowing that ones eyes are parallel to the target, the present invention improves the golfers ability to consistently align the putter blade square to the target.

With regard to buidling a consistent set-up, the present invention provides a height indicator on second mirror. When the golfer addresses the ball, establishes a comfortable set up and his eyes become visible in both mirrors, the indicator can be set to mark the location of the bridge of the golfer's nose as it is seen in second mirror. Now, each successive set up the golfer can repeat his exact height over the ball by lining up the bridge of his nose with the indicator on second mirror. The golfer is in effect finding a specific point in space which is directly above the golf ball. By practicing with the present invention the golfer will be able to build a repeatable and consistent putting set-up to be used in competition.

With regards to stroking the putter along the inside of the line, the aluminum guide rail creates an outer limit of the intended line. Strokes which go outside the line impart side and back spin which greatly reduces the golf ball's trueness of roll. By practicing with the present invention, a repeating inside stroke is developed which consistently imparts greater top spin which naturally generates a truer roll of the golf ball.

With regard to detecting detrimental head movement using the present invention, the golfer can set up, align eyes in mirrors, stroke ball and immediately eyeball glance back at mirrors and accurately determine if his eyes moved during the stroke. The ability to keep one's eyes and head steady during a putt is evident in all the great putters in the world. By practicing with the present invention, one can determine his pattern for head movement, learn to eliminate movement and allow the putter to remain on line throughout the stroke.

Figure 1B:
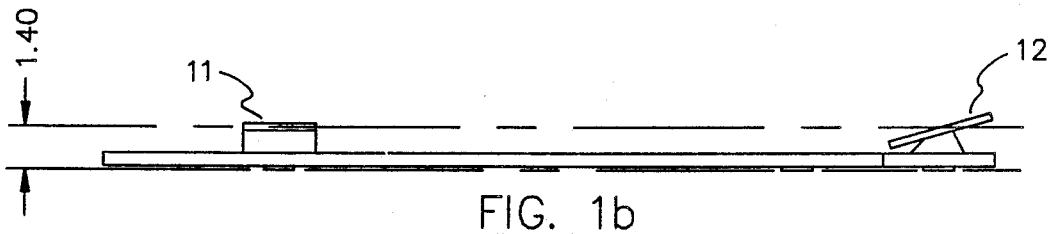
FIG. 1*b* A side view of the simplest embodiment of the present invention.
Figure 1C:
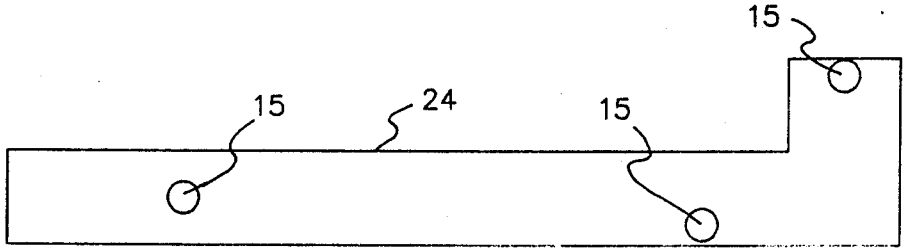
FIG. 1*c* A bottom view of the simplest embodiment of the present invention.

To top view of FIG. 1, the simplest embodiment of the present invention, best shows what the golfer will see in first and second mirror when his eyes are directly over the golf ball 23. The top view also shows the dimensions from centerline of the mirrors to centerline of golf ball 23 used to calculate tilt angles of each mirror. The bottom view shows the three mounting pads 15 which provide consistent alignment over uneven surfaces and are not completely necessary when using the device on flat surfaces.

Figure 2:
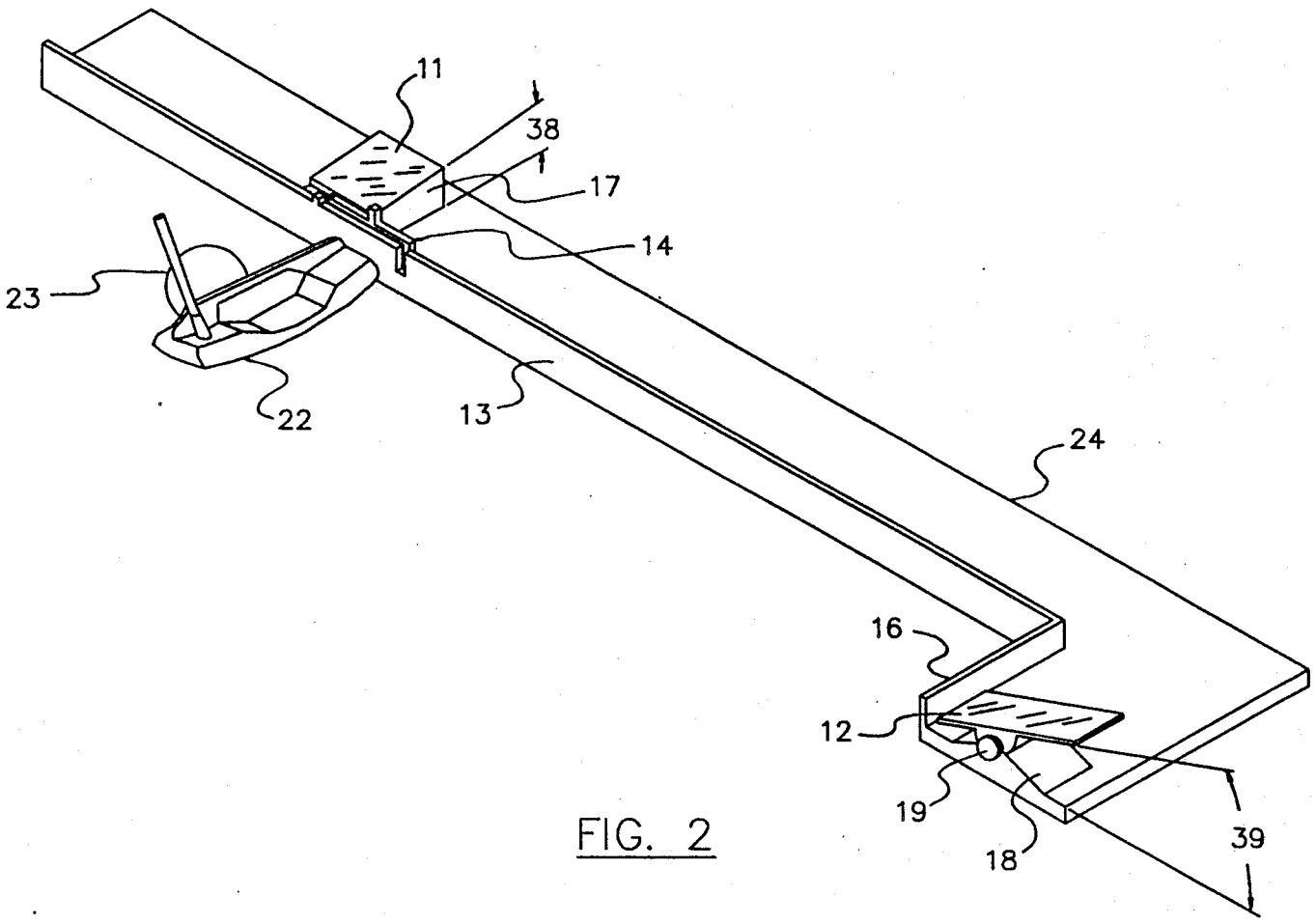
FIG. 2 An isometric drawing of improved version of invention showing putter and golf ball.
Figure 7:
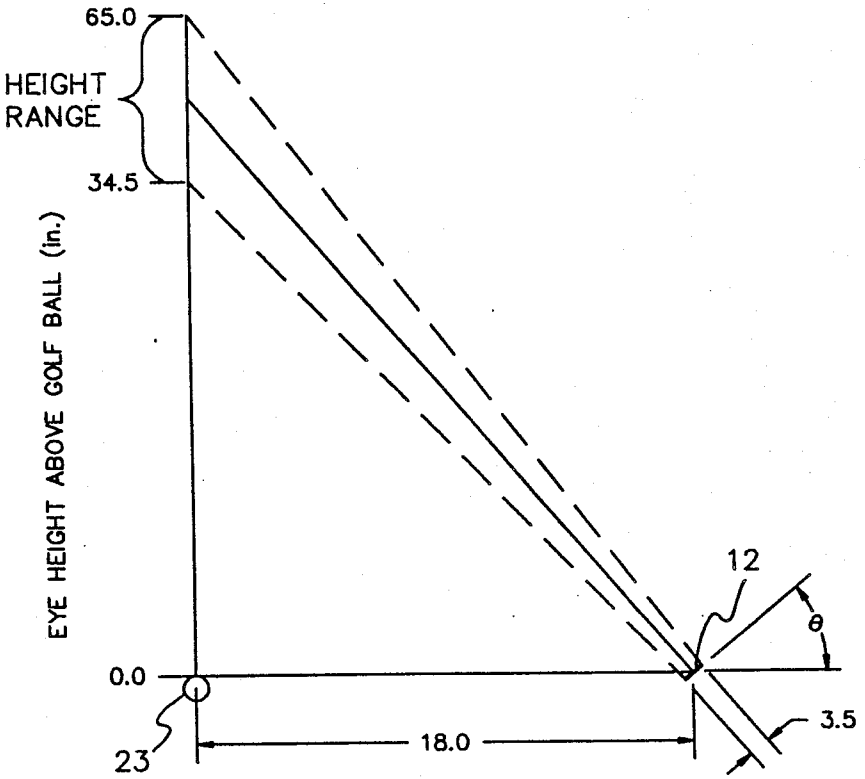
FIG. 7 A height chart and analysis of various angles of tilt of second mirror.
Figure 6:
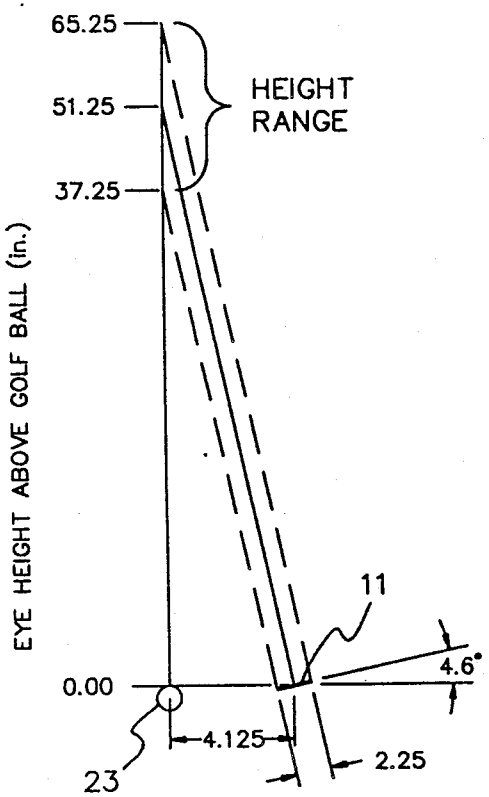
FIG. 6 Height analysis and angle calculations of first mirror.

Turning to FIG. 2 an improved version of the present invention, an L-shaped base 24 is shown which is supported by three mounting pads 15 (FIG. 2). First mirror 11 mounted on a fixed base 17 and set at a specific angle 38 (Ref. FIG. 6.) and second mirror 12 mounted on an adjustable tilt base 18 with varying angles (Ref. FIG. 7), are mounted to the L-shaped base 24 and are set at 90 degrees to one another. A guide rail 13 and second mirror 12 safety stop are mounted along the inside of the L-base 24. A pivot arm ball positioner 30 accurately positions the golf ball 23 in line with mirrors.

Figure 3A:
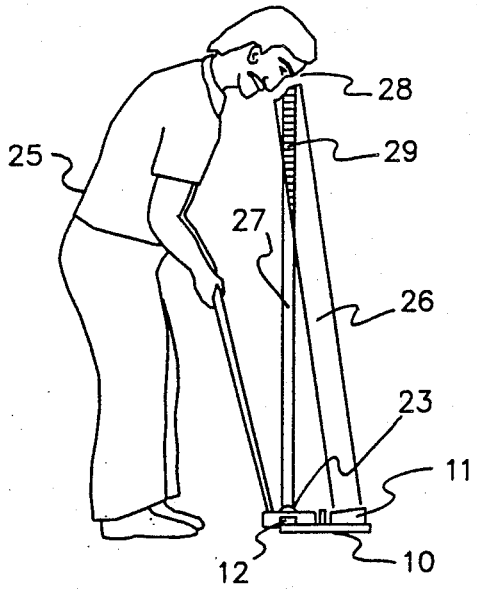
FIG. 3*a* A rear elevation view of golfer using the present invention and showing first and second mirror reflection planes and their subsequent intersection being the shaded zone.
Figure 3B:
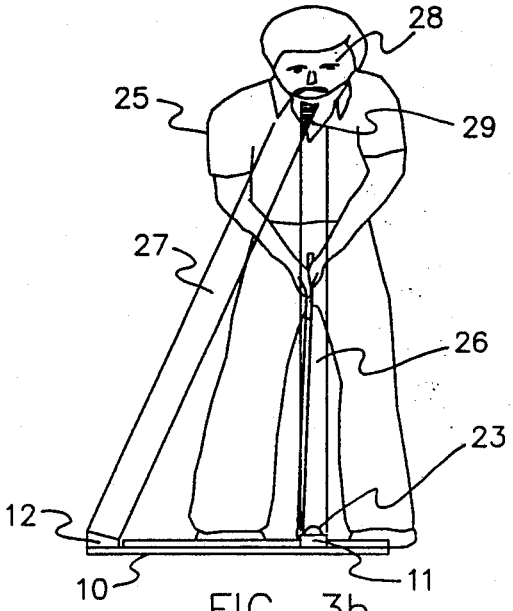
FIG. 3*b* A side elevation view of golfer using the present invention and showing first and second mirror reflection planes and their subsequent intersection being the shaded zone.

The golfer 25 in FIG. 3 is shown setting to the present invention 10 with his eyes 28 directly over the golf ball 23 and in the reflection plane intersection zone 29. In the rear view, it is easy to see that if the golfer 25 were to set up too far outside the line or too far inside the line, he would move outside the reflection plane 27 of second mirror 12 and his eyes would not be visible to him. Conversely, in the side view, it is easy to see that if the golfer 25 were to set up to far forward or backward, he would move outside the reflection plane 26 of first mirror 11 and again his eyes would not be visible to him. Therefore, when the golfer 25 sets up directly over the golf ball 23 his eyes 28 are visible to him in both mirrors at the same time.

Figure 4A:
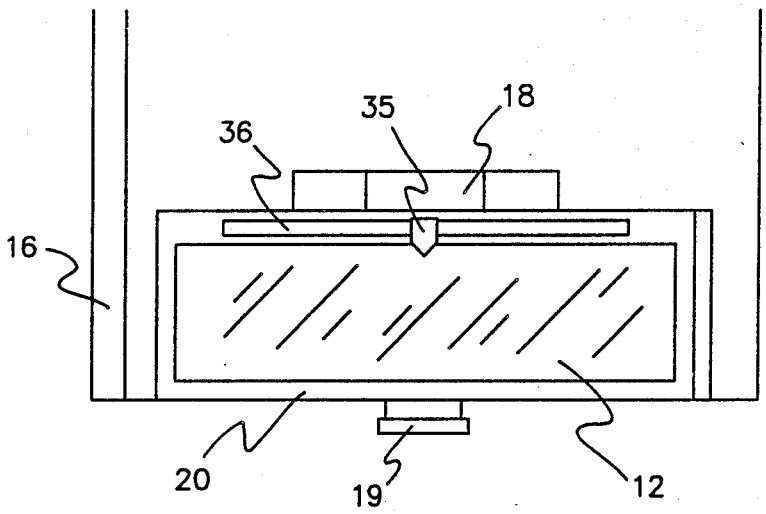
FIG. 4*a* A top plan detail of second mirror and adjustable tilt base.
Figure 4B:
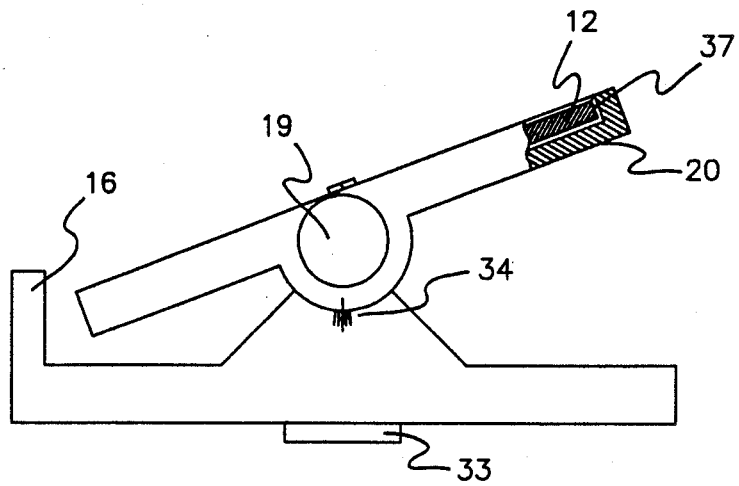
FIG. 4*b* A side elevation detail of second mirror and adjustable tilt base.

A detail top and elevation view of second mirror 12 and the adjustment tilt mechanism are shown in FIG. 4. The knob 19 is fastened to a bolt which slides through a clearance hole in second mirror frame 20 and is threaded into tilt base 18. The knob 19 securely locks the mirror frame 20 into place once the desired angle division mark 34 is selected. Angle and height settings are shown in FIG. 7. The second mirror 12 is recessed below the mirror frame 20 and is secured in place by and elastic bonding agent 37. The recess of second mirror 12, the elastic bonding agent 37, and the protective stop 16 for second mirror 12 provide safety and reliability against breakage of second mirror 12. Although a detail cross-section of first mirror 11 is not shown, the same recess and elastic bonding agent 37 are used on first mirror 11. The top view shows the height indicator 35 which can be moved along the slot 36. As previously mentioned, the golfer can mark the position of the bridge of his nose as viewed in second mirror 12 to set his height above the golf ball.

Figure 5A:
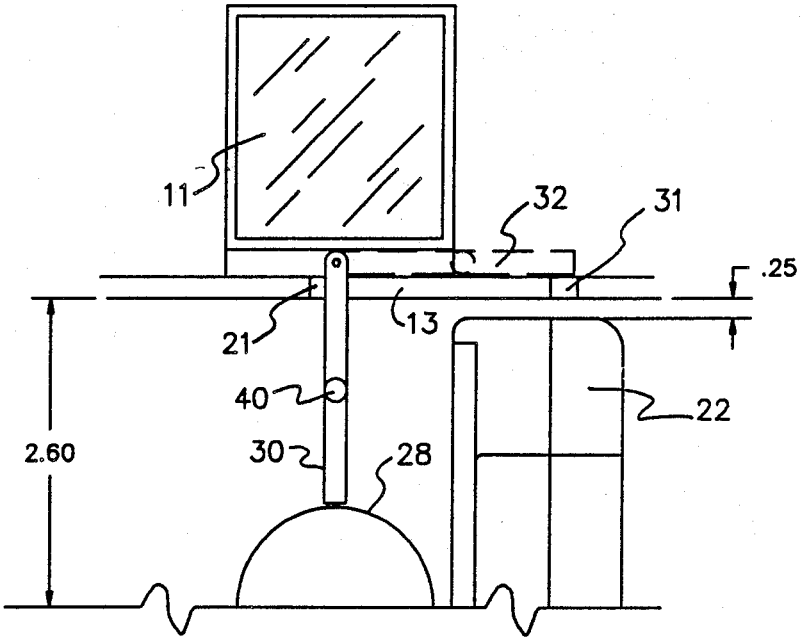
FIG. 5*a* A top plan detail of first mirror and pivot arm ball positioner.
Figure 5B:
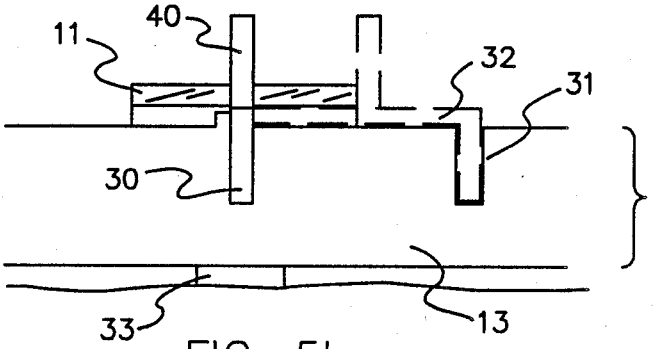
FIG. 5*b* A side elevation detail of first mirror and pivot arm ball positioner.

A detail of the pivoting arm ball positioner 30 is shown in FIG. 5. The pivot arm ball positioner 30 is used in the following sequence. (1) the golfer moves the pivot arm 30 from the retracted position 32 into the ball locating position by using his putter head and pushing the vertical extending member 40 until the pivot arm rests against stop 21. (2) the golfer then uses his putter head to push the golf ball 23 against the flat pivot arm ball positioner 30. (3) the golfer then retracts the pivot arm 30 by moving his putter head against the extending member 40 and swinging the pivot arm 30 through the guide rail opening 31 into the retracted position 32. The golf ball 23 is now positioned on the centerline of first mirror 11 and second mirror 12 as shown in the top view of (FIG. 2). Accurate ball positioning is accomplished with the putter head in a matter of seconds and the golfer is ready to line up and stroke the golf ball 23. The golfer may only find it necessary to use the pivot arm ball positioner on the initial few putts, once the correct ball position has been established the golfer should be able to adequately duplicate its position on subsequent putts. The length of the pivot arm 30 is set to position the golf ball 2.6 inches from the guide rail 13. This allows approximately 0.25 inches clearance between the putter 22 and the guide rail 13 when using a standard width putter and aligning to its sweet spot.

In FIG. 6, the location of first mirror 11 is close to the golf ball 23 and therefore the angle of tilt is very little. This allows for a large variance of heights above the ball the golfer can stand before his eyes move out of the reflection plane. Conversely, in FIG. 7, the distance the second mirror places from the golf ball is longer because room must me made for the golfer's backstroke. This longer length from the ball creates a steeper angle and therefore less height range per angle setting. For this reason, an adjustable mechanism is provided for the second mirror to increase the height range to a level consistent with the first mirror and as needed to meet height differences of various users.

The angle range chart for mirror 2 shows the allowable golfer height range above the golf ball for each angle setting of mirror 2. The total adjustable range of this mirror is from 17 to 25 degrees which allows for golfer height variations from 34.5 to 65.0 inches above the golf ball. This usable range correlates to the non-adjustable range of mirror 1, thus allowing golfer's with height variations from 34.5 to 65.0 inches above the golf ball to be able to see their eyes in both mirrors at the same time when they are directly over the golf ball.

I claim:

1. A device for assisting a golfer during practice putting, comprising;

(a) a base member having first and second mirrors mounted thereon;

(b) said first mirror positioned directly in front of the golfer where the stance is to be taken;

(c) said second mirror positioned on base extension to the right, or left, of golfer and directly behind the proper location of the golf ball;

(d) both mirrors having a directional slant toward the golfer's proper head position, so that the golfer will be able to see his eyes reflected in both mirrors when his head is properly aligned directly above the golf ball.

2. A device as in claim 1 wherein the two mirrors establish intersecting viewing planes directly above the golf ball, said first mirror facing the golfer establishes forward-backward alignment plane, said second mirror establishes inside-outside alignment plane, and both planes intersect directly above the golf ball from 36 to 60 inches.

3. A device as in claim 1, further including a large enough first mirror to allow for golfer height variations from 36 to 60 inches above the golf ball before the golfer's eyes move out of view in said first mirror.

4. A device as in claim 1, further including an angle adjustment mechanism for said second mirror to allow for golfer height variations from 36 to 60 inches above the golf ball.

5. A device as in claim 4, further including an angle lock down knob for the adjustment mechanism to set said second mirror at specific angles.

6. A device as in claim 1, further including a 1–2 inch wide guide rail mounted to the inside of said base member adapted to be aligned towards a putting target and used to keep the putting stroke on the correct inside path.

7. A device as in claim 2, further including a pivoting arm ball positioner which swings out perpendicular to said base member and positions the golf ball directly below said said intersecting viewing planes.

8. A device as in claim 1, further including an abrasion blasted dull finish of all exterior surfaces to eliminate glare from sunlight.

9. A device as in claim 1 further including a three point mounting system where the pads are mounted to the underside of said base member to provide consistent level positioning of the system over irregular putting surfaces.

10. A device as in claim 1, further including an adjustable height pointer wherein the pointer can be moved along said second mirror and locked down at any position to indicate the golfer's height above the golf ball.

11. A device as in claim 1, further including a putter safety stop mounted to the inside of said base member and extending above said second mirror to protect the mirror against errant back strokes.

12. A device as in claim 1, further including first and second mirror recessed below the surface of their respective mounting bases for safety and reliability against breakage.

13. A device as in claim 12, further including the use of an elastic bonding agent for mounting said first and second mirrors in their respective recesses to reduce chance of breakage caused by impact to structure.

14. A device for assisting a golfer during practice putting, comprising;

(a) a base member having first and second mirrors mounted thereon;

(b) said first mirror positioned directly in front of the golfer where the putting stance is to be taken, about $4\frac{1}{8}$ inches away from the golf ball, is at least 2.25 inches long and is tilted toward the golfer at an angle of 4.6 degrees in relation to base member bottom locating surface;

(c) said second mirror positioned on base extension to the right, or left, of golfer and directly behind the proper location of the golf ball, is about 18 inches from golf ball, is at least 3 inches long, and is tilted towards golfer from 17 to 25 degrees in relation to the base member bottom locating surface.

* * * * *